US008671628B2

(12) United States Patent
Sighinolfi

(10) Patent No.: US 8,671,628 B2
(45) Date of Patent: Mar. 18, 2014

(54) SPACING/LEVELLING DEVICE FOR LAYING SLAB PRODUCTS FOR SURFACE CLADDING

(75) Inventor: Giorgio Sighinolfi, Rubiera (IT)

(73) Assignee: Raimondi S.p.A., Modena (IT)

( * ) Notice: Subject to any disclaimer, the term of this patent is extended or adjusted under 35 U.S.C. 154(b) by 0 days.

(21) Appl. No.: 13/598,322

(22) Filed: Aug. 29, 2012

(65) Prior Publication Data

US 2013/0055675 A1 Mar. 7, 2013

(30) Foreign Application Priority Data

Sep. 5, 2011 (IT) ..... RE2011A0065

(51) Int. Cl.
*E04B 2/82* (2006.01)
*E04B 9/00* (2006.01)
*E04G 1/22* (2006.01)

(52) U.S. Cl.
USPC ..... 52/126.1; 52/749.11; 52/746.12; 52/392; 52/747.11; 52/DIG. 1; 33/527; 33/533

(58) Field of Classification Search
USPC ..... 52/749.11, 391, 746.12, 392, 747.11, 52/DIG. 1, 127.1, 126.1, 111; 33/526, 527, 33/533, 613
See application file for complete search history.

(56) References Cited

U.S. PATENT DOCUMENTS 5,675,942 A * 10/1997 Crawford ..... 52/127.3
6,363,685 B1 4/2002 Kugler
7,257,926 B1 * 8/2007 Kirby ..... 52/126.5
7,621,100 B2 * 11/2009 Kufner et al. ..... 52/749.11
7,861,487 B2 * 1/2011 Kufner et al. ..... 52/749.11
7,946,093 B1 * 5/2011 Sturino ..... 52/749.11
7,954,300 B1 * 6/2011 Kufner et al. ..... 52/749.11
7,992,354 B2 * 8/2011 Doda, Jr. ..... 52/127.7
8,079,199 B1 * 12/2011 Kufner et al. ..... 52/749.11
8,429,878 B1 * 4/2013 Hoffman et al. ..... 52/747.11
2010/0287868 A1 11/2010 Kufner et al.

FOREIGN PATENT DOCUMENTS

BE 815222 A1 9/1974
DE 8710335 U1 9/1987
WO 2008118418 A1 10/2008

* cited by examiner

*Primary Examiner* — Chi Q Nguyen
(74) *Attorney, Agent, or Firm* — Volpe and Koenig, P.C.

(57) ABSTRACT

An intake manifold (2) of comburent air is presented for an internal combustion engine (1) provided with a recirculating conduit (60) of exhaust gases. The intake manifold (2) includes a first inlet mouth (213) of the comburent air, a second inlet mouth (214) in communication with the recirculating conduit (60) of the exhaust gases, and a plurality of outlet mouths (201), having a wall (7) positioned in front of each of the outlet mouths (201) and configured for dividing the internal volume of the intake manifold (2) into two chambers (215, 204), the first chamber (215) being placed in communication with the first inlet mouth (213) and the second inlet mouth (214) and the second chamber (204) being placed in communication with the outlet mouths (201), the wall (7) defining an opening (70) adapted for placing the first chamber (215) and the second chamber (204) in communication.

13 Claims, 9 Drawing Sheets

SPACING/LEVELLING DEVICE FOR LAYING SLAB PRODUCTS FOR SURFACE CLADDING

TECHNICAL FIELD

The present invention relates to a spacing/levelling device for laying slab-shaped products, such as tiles and the like, for cladding surfaces.

PRIOR ART

In the sector of laying tiles for cladding surfaces, such as floorings, walls and the like, the use of spacer devices is known, which, as well as spacing the tiles, enable them also to be laid in planar fashion. These devices are commonly known as spacing/levelling devices.

Spacing/levelling devices of known type generally comprise a base, positionable below the laying surface of at least two adjacent tiles, from which at least a separator element projects which is destined to contact, with its lateral flanks, the facing sides of the two tiles to be arranged adjacent on the laying surface.

The spacing/levelling device is also provided with presser means which press the in-view surfaces of the products towards the base in such a way as to level them, cooperating with the portion of the separator element which emerge above the plane defined by the in-view surface of the tiles.

Although these spacing/levelling devices are particularly effective in their tile-levelling action, they however have the drawback of not being applicable at the corners of the slab products, i.e. where a greater precision is necessary in the carrying-out of the alignment along the flanking direction of the products and also in the laying thereof, such as to prevent the surface from being irregular.

Also known for the squared arrangement of the tiles, between the corners of the tiles, is the use of other types of spacing devices, or cross spacers, which, though particularly effective for the equidistant and regular flanking of the tiles, do not however perform any levelling function; another alternative is the expert eye of the technical expert when laying.

There is, therefore, in any case the need to use more than one type (for example up to three different types) of spacing/levelling devices or non-levelling devices according to whether it is necessary to act on the lateral edges of the tile or the corners thereof.

This spacing devices are differentiated, for example, by the arrangement of the elements projecting from the base which separates the tiles; in particular three different types of spacer are known, a first of which exhibits a cross-conformation in plan view, a second of which is T-shaped and a third of which is simply straight, such that they can be respectively used in different zones of the tile, as is more clearly visible in FIGS. 1*a*, 1*b* and 1*c*, in which three different possible known tile-laying schemes are known.

Examples of levelling spacers of known type are described in documents nos. BE 815 222 and WO 2008/118418.

An aim of the present invention is to obviate the above-mentioned drawbacks in the prior art, with a solution that is simple, rational and relatively economical.

These aims are attained by the characteristics or the invention as reported in the independent claim. The dependent claims delineate preferred and/or especially advantageous aspects of the invention.

DESCRIPTION OF THE INVENTION

In particular, the invention discloses a spacing/levelling device for laying slab-formed products for cladding surfaces that comprises a base, positionable below the laying surface of at least two adjacent and flanked slab products with respect to a flanking direction, from which at least a separating element projects, suitable for contacting at least a portion of the facing flanks of the two slabs, and presser means associated to the separator element suitable for pressing the in-view surfaces of the slab products such as to level them, characterised in that it comprises at least a corner spacer which projects from the base with respect to the separating element and is suitable for coming into contact with the flanks that are perpendicular to the facing flanks of the slab products for aligning thereof along a perpendicular direction to the flanking direction, the corner spacer being mobile between a raised position, in which it projects superiorly of the base, and a non-interfering position with the perpendicular flanks of the products, or a lowered position; for example, in the non-interfering position the area of the corner spacer is at least partially contained within the area of the base.

Thanks to this solution, the spacing/levelling element can be used both at the lateral edges of two slab products to be flanked and at the corners of the products to be arranged squared, independently of the laying scheme of the products, while at the same time having a levelling function for the products laid and a distancing function for between the products themselves.

BRIEF DESCRIPTION OF THE DRAWINGS

Further characteristics and advantages of the invention will emerge from a reading of the following description provided by way of non-limiting example, with the aid of the figures illustrated in the accompanying figures of the drawings.

DETAILED DESCRIPTION OF THE PREFERRED EMBODIMENTS

Figure 1:
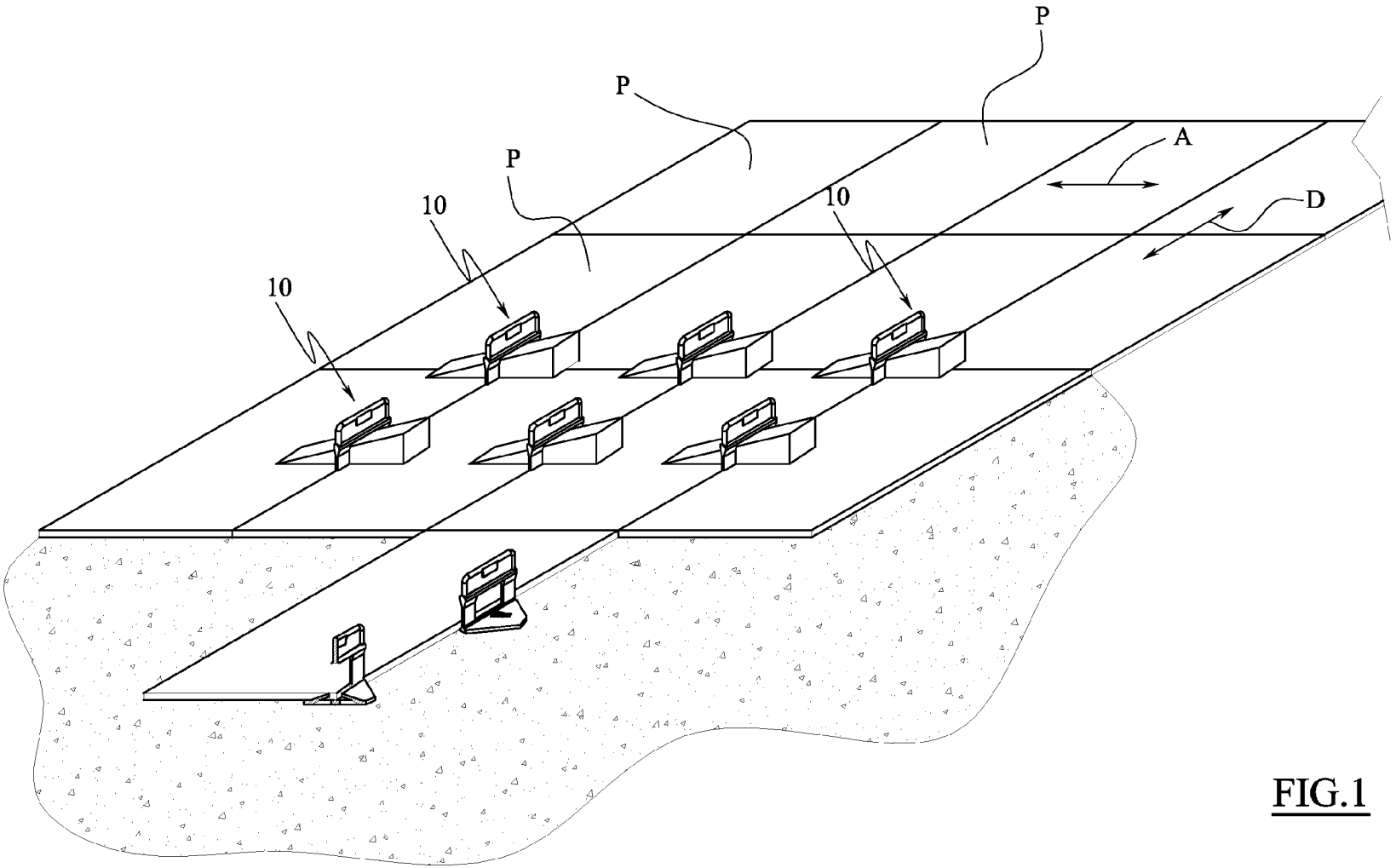
FIG. 1 is an axonometric view of a surface covered with tiles by means of the spacing/levelling device according to the device.
Figure 1A:
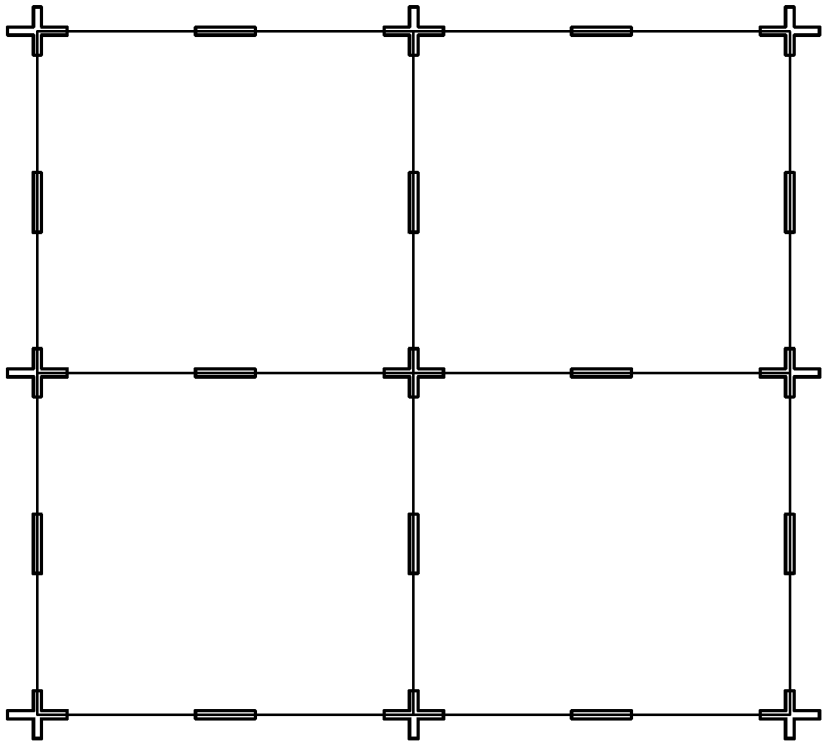
FIG. 1*a* is a schematic plan view of a first possible laying scheme of slab products in a shoulder-to-shoulder arrangement.
Figure 1B:
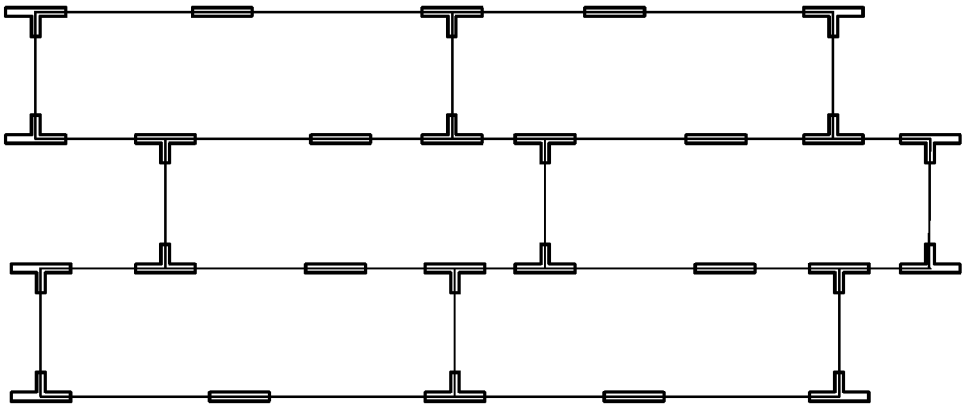
FIG. 1*b* is a schematic plan view of a second possible laying scheme of slab products in a staggered arrangement.
Figure 1C:
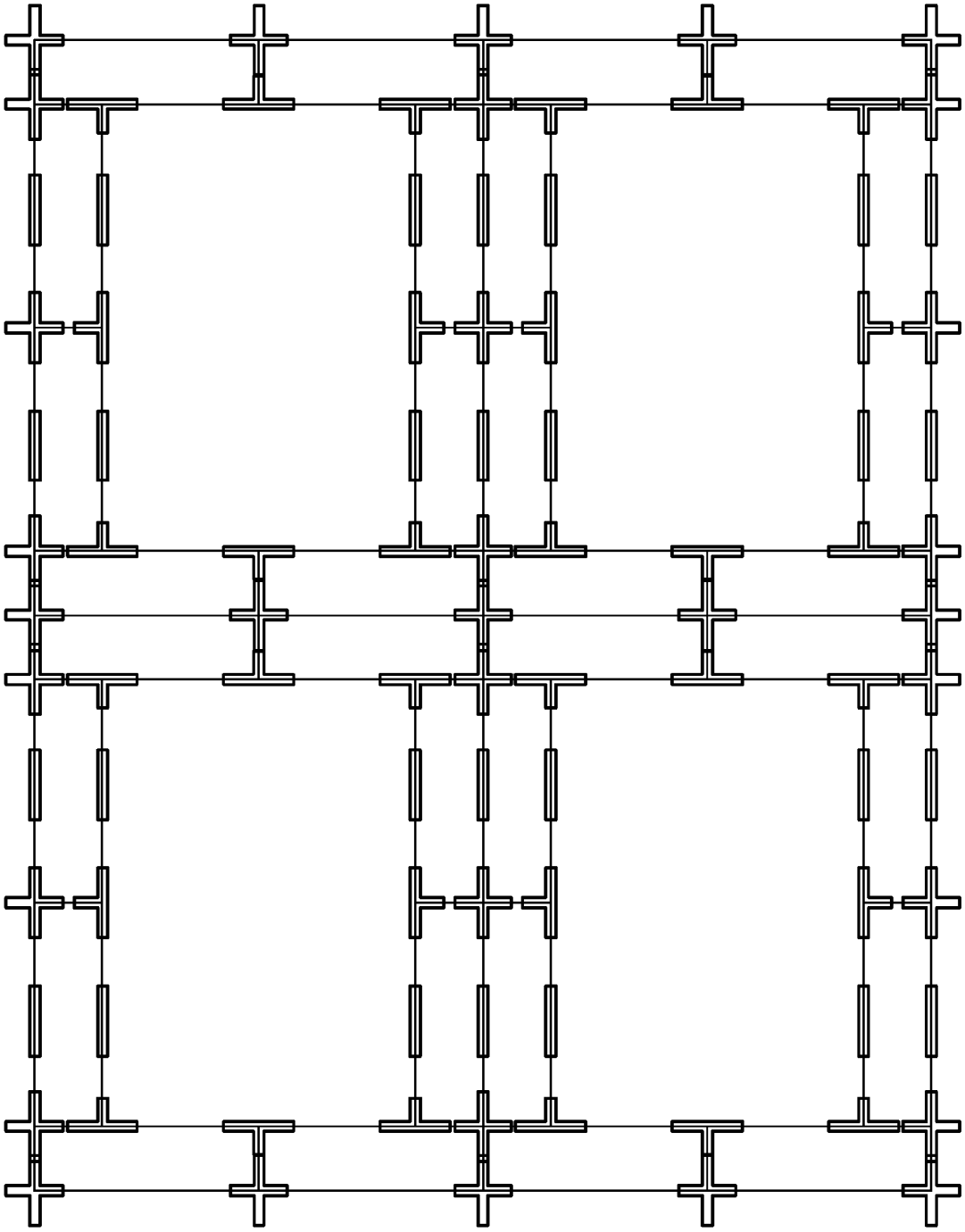
FIG. 1*c* is a schematic plan view of a third possible laying scheme of slab products in a complex arrangement.

With particular reference to the figures of the drawings, 10 denotes in its entirety a spacing/levelling device suitable for facilitating laying of slab products, such as tiles and the like, denoted in their entirety with the letter P, and destined to clad surfaces, i.e. floorings, walls and the like.

The device 10 comprises a base 20 having a broad shape, for example polygonal, circular or an irregular shape defining a lower surface 21, for example flat, suitable for being resting on a layer of adhesive arranged on the floor surfaces which is destined to be covered by the tiles P.

The upper surface 22 of the base 20 is, differently, suitable for restingly receiving a portion of the laying surface of one or more tiles P.

In practice, the base 20 is positioned below at least two (or more) adjacent tiles, as will more fully emerge in the following.

A separator element 30 emerges from the base 20, which separator element 30 is destined in use to contact at least a portion of the facing flanks of at least two tiles P to be flanked along a flanking direction indicated with letter A in the figures.

The separator element 30 is a slab-shaped parallelepiped body, for example having a rectangular base which defines a slim separating wall developing in a perpendicular direction with respect to the base and destined to separate the two flanked tiles P by a distance that is equal to its thickness.

In particular, the separator element 30 comprises two lateral flanks 31 parallel to one another.

Further, the separator element 30, in the embodiment shown in the figures, exhibits a greater height than the thickness of the tiles P to be laid, such that the top of the separator element, once the tiles P are resting on the upper surface 22 of the base 20, projects superiorly (by a good amount) above the plane to be leveled defined by the laying surface of the tiles P.

Further, the separator element 30 is provided with a window 32 passing from side to side in a transversal direction, the upper edge 33 of which is destined to be located superiorly of the level of the in-view surface of the tiles P to be leveled and the lower edge 34 of which is destined to be laid inferiorly of the level (for example coinciding with the base 20).

Further, the separator element 30 exhibits a line or section having a pre-determined break 35 which in use will be arranged inferiorly at the level of the in-view surface of the tiles to be spaced and leveled, for example at the same level as or at a lower level than the upper surface 22 of the base 20.

Thanks to this pre-determined break line or section 35, the emerging portion of the device 10 can be easily removed, once the tiles P have been laid and the adhesive supporting them has solidified.

The device 10 further comprises presser means associated to the separating element 30 and suitable for pressing the in-view surfaces of the tiles P towards the base 20, such as to level the tiles.

Figure 2:
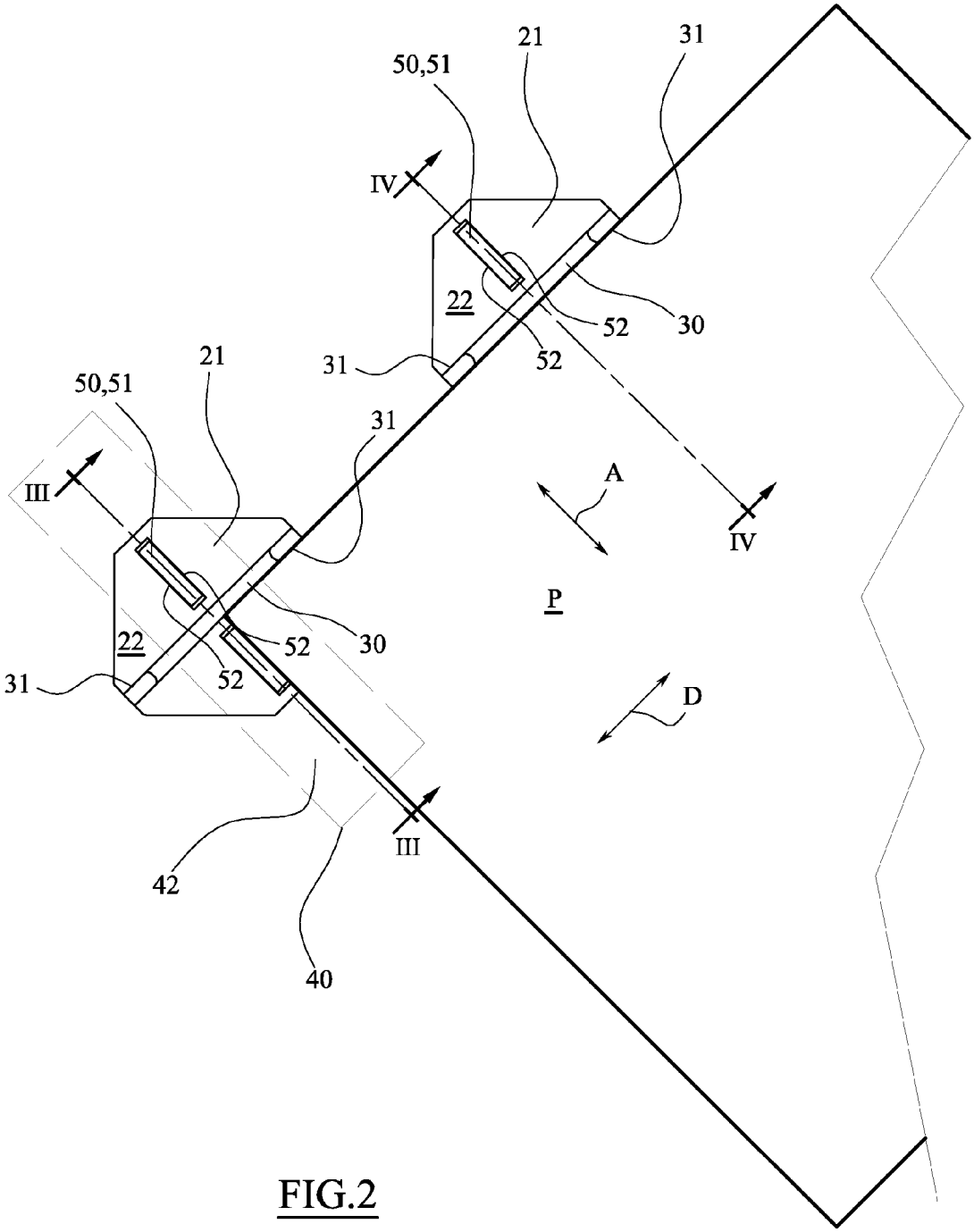
FIG. 2 is a plan view of a detail of FIG. 1.
Figure 3:
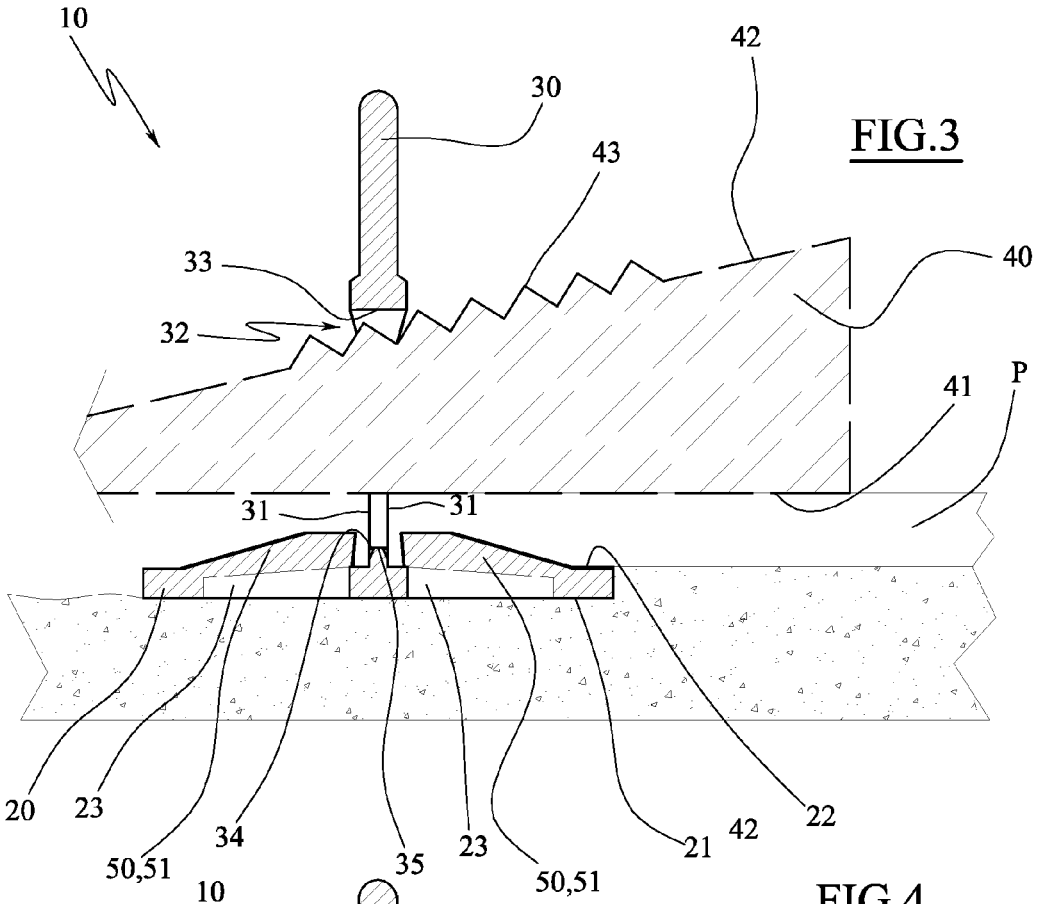
FIG. 3 is the view along section line III-III of FIG. 2.
Figure 4:
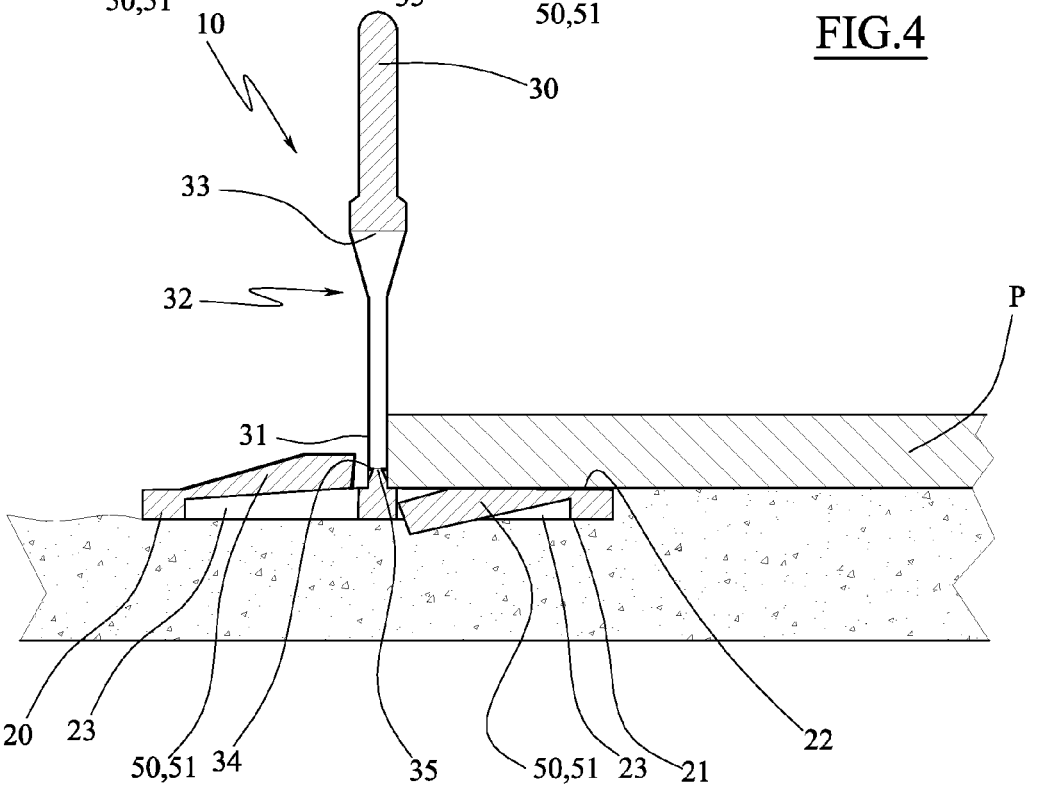
FIG. 4 is a view along section line IV-IV of FIG. 2.
Figure 5:
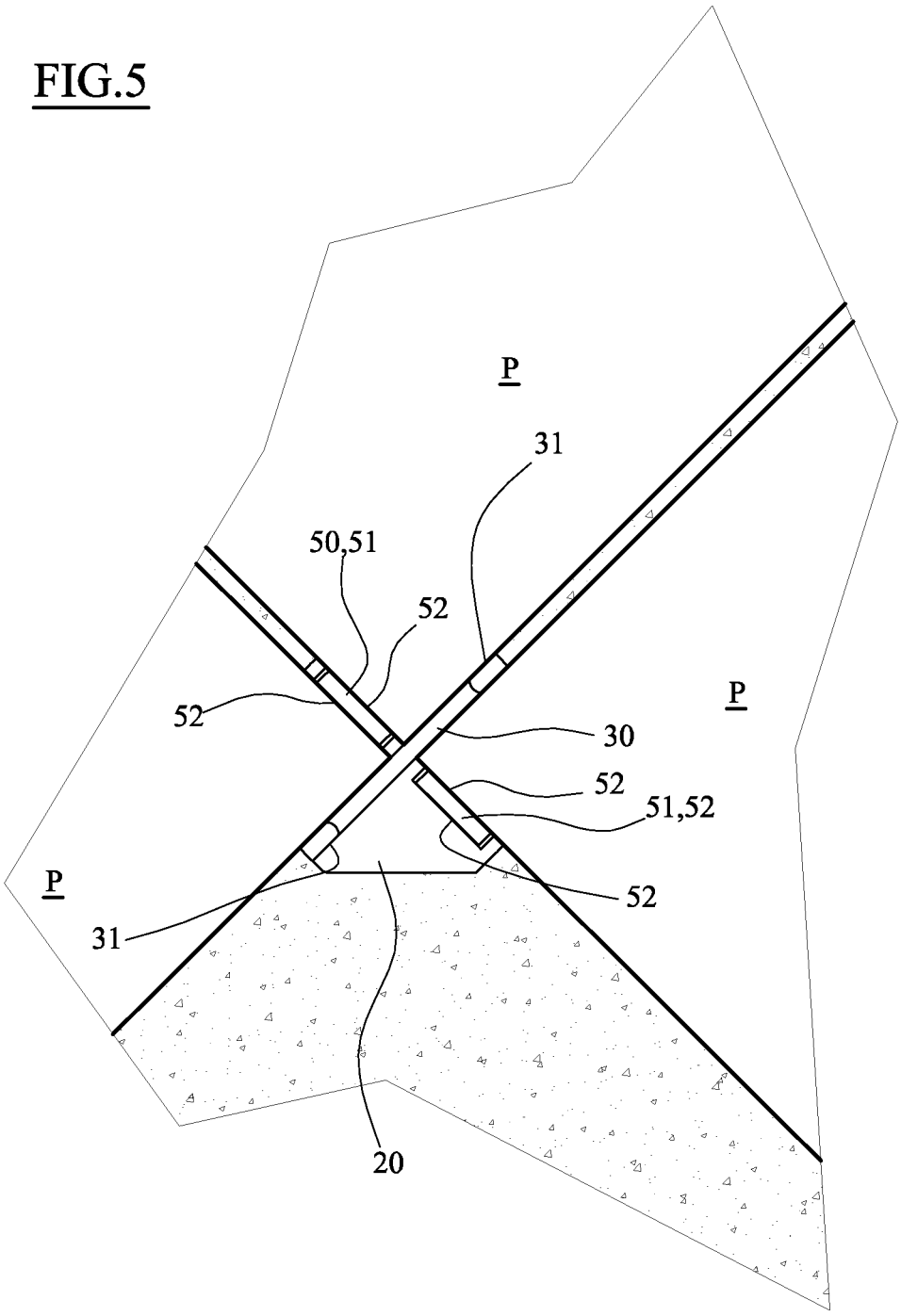
FIG. 5 is a plan view of a further detail of FIG. 1.
Figure 6:
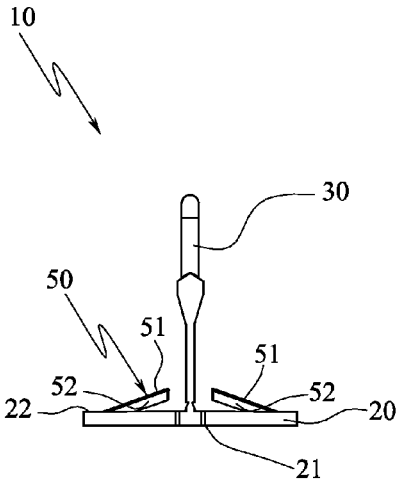
FIG. 6 is a lateral view of a first variant of a first embodiment of the spacing/levelling device according to the invention.
Figure 7:
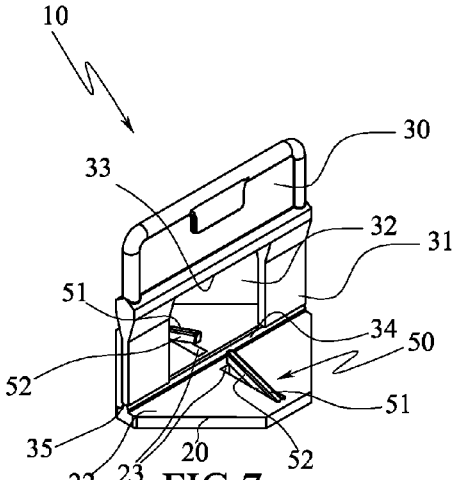
FIG. 7 is an axonometric view from above of FIG. 6.
Figure 8:
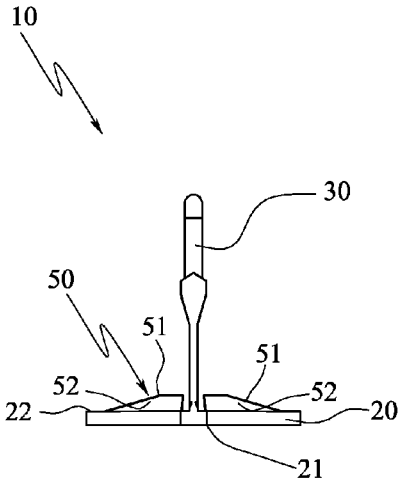
FIG. 8 is a lateral view of a second variant of the first embodiment of the spacing/levelling device of the invention.
Figure 9:
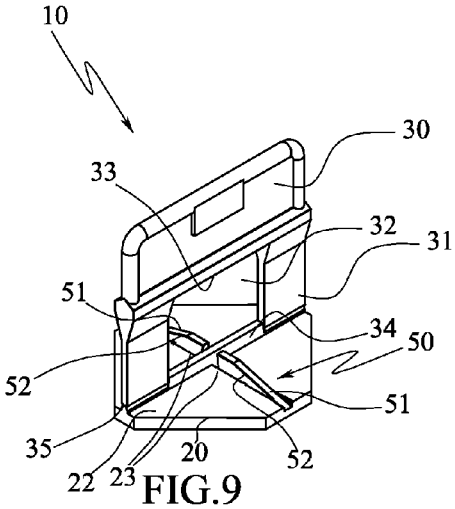
FIG. 9 is an axonometric view from above of FIG. 8.
Figure 10:
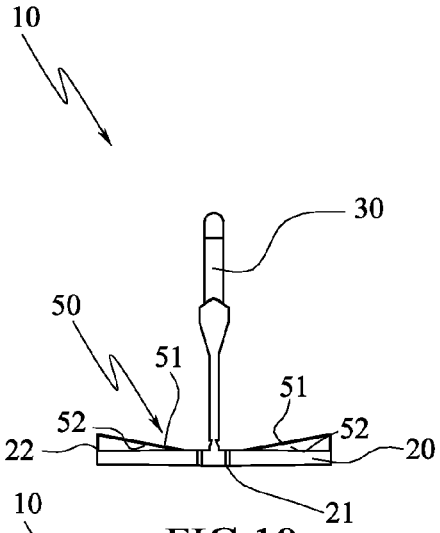
FIG. 10 is a lateral view of a third variant of the first embodiment of the spacing/levelling device of the invention.
Figure 11:
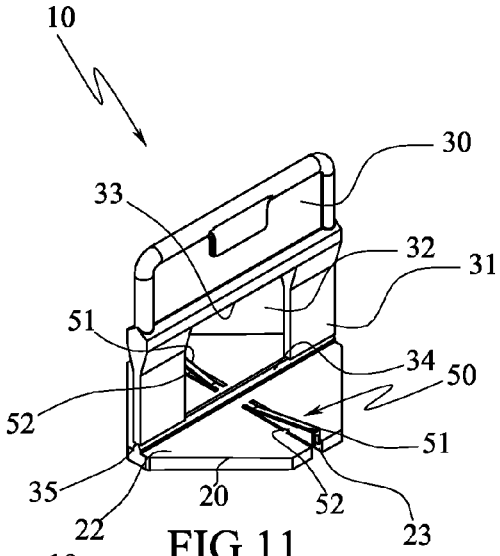
FIG. 11 is an axonometric view from above of FIG. 10.

In particular, the presser means comprise a wedge element 40 (visible for the sake of simplicity only in FIGS. 2 and 3) provided with a lower surface 41 that is flat and suitable for being arranged in use parallel to the base 20 and an upper surface 42 that is inclined and provided with abutting elements, such as small teeth 43 or knurling (visible in FIG. 3, where the wedge element 40 has been drawn schematically in a broken line).

The wedge element 40 can be inserted internally of the window 32 such as to slide, with the lower surface 41 resting on the in-view surfaces of the tiles P, such that the upper surface 42 thereof goes into contact with the upper edge 33 of the window 32—for example such that the teeth 43 engage the upper edge—and the wedge element 40 is thus pressed against the tile P and pushes the tiles towards the base 20.

The separating element 30 exhibits a reinforcement, for example a zone having an increased section, located superiorly to the window 32 and able to prevent, in use, flexion of the separating element when the wedge 40 is forced into the window 32. It is however not excluded that the presser means can alternatively comprise a block destined to slide along the separator element and provided with teeth suitable for engaging a rack associated to the separator element or another system of known type suitable for imparting a gradual and substantially uniform pressure on the in-view surface of the two or more flanked tiles P to be leveled.

In particular, for the aims of the present invention, the device 10 comprises at least a corner spacer 50 which projects from the base 20, squared with the separator element 30.

In practice, in plan view the separator element 30 and the corner spacer 50 are arranged in a cross.

The corner spacer 50 is destined to go into contact with the perpendicular flanks to the facing flanks of the tiles P in order to align the perpendicular flanks along a direction D that is perpendicular to the flanking direction A.

The corner spacer 50 is, advantageously, mobile between a raised position, in which it projects superiorly to the base 20 and is raised with respect thereto and a non-interfering position with the perpendicular flanks of the tiles P (with respect to direction D).

In practice, the corner spacer 50 can be configured such that in the non-interfering configuration thereof it lowers such that its vertical dimension is contained totally or partially in the vertical dimension (thickness) of the base 20.

In the example, the corner spacer 50 comprises at least a block 51 provided with two lateral flanks 52, which, when the block 51 is in the raised position, will come into contact with the flanks of two tiles P to be flanked along the direction D.

In the preferred embodiment illustrated in the figures, the block 51 is associated to the base 20 in such a way that in the non-interfering position the lateral flanks 52 are all contained within the vertical dimension of the base 20, i.e. the block 51 is hidden in the base 20, and in the raised position emerge superiorly to the base such that they can function as abutting elements for the flanks of the tiles P to be arranged squared.

The thickness in plan view of the corner spacer 50 is advantageously substantially equal to the plan thickness of the separator element 30, such that the tiles P are distanced both along direction D and along flanking direction A by a same distance.

It is however possible that the thickness in plan view of the corner spacer 50 is different to the thickness in plan view of the separator element 30 according to the different laying requirements of the tiles P.

In the illustrated examples, the device 10 comprises, in the example, at least two corner spacers 50, as described above and independent of one another, which are arranged on the opposite sides with respect to the separator element 30.

The lateral flanks 52 of the two corner spacers 50 are two-by-two substantially coplanar and perpendicular to the lateral flanks 31 of the separator element 30, such as to guarantee the effective alignment of the flanks of the tiles P along direction D.

It is however possible that the device 10 might alternatively comprise a single corner spacer 50 which crosses the separator element 30 (for example through the window 32).

In a preferred embodiment shown in FIGS. 6-11, the block 51 is realised in at least a plastically or elastically yielding material and develops projectingly from the base 20.

In practice, each block 51 exhibits a free end with the opposite end fixed to the base 20 and is realised in a single piece with the base.

Figure 12:
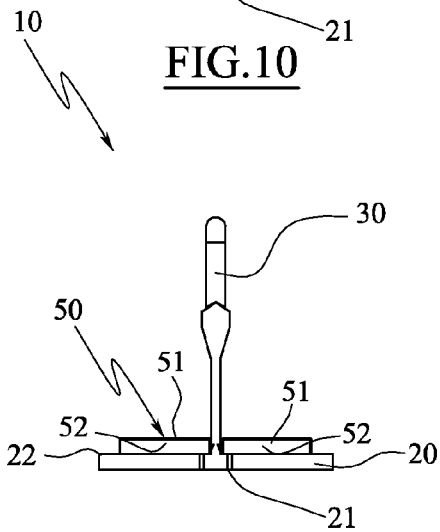
FIG. 12 is a lateral view of a second embodiment of the spacing/levelling device according to the invention.
Figure 13:
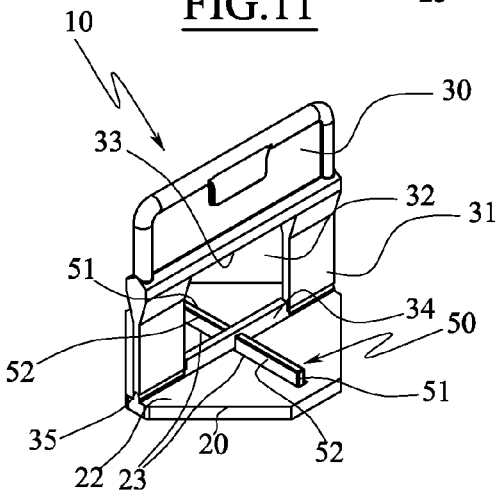
FIG. 13 is an axonometric view from above of FIG. 12.
Figure 14:
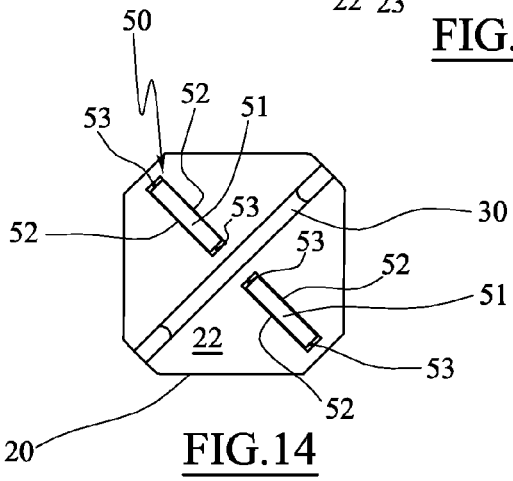
FIG. 14 is a plan view of FIG. 13.
Figure 16:
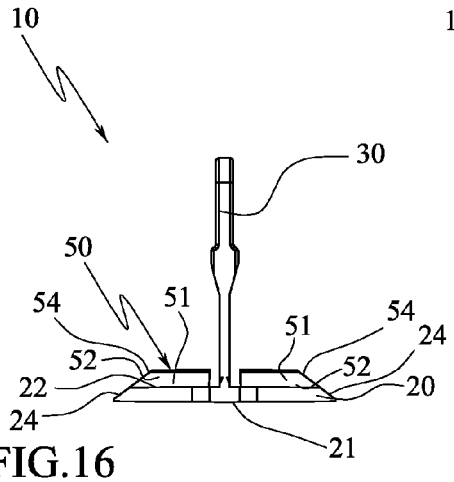
FIG. 16 is a lateral view of FIG. 15.
Figure 17:
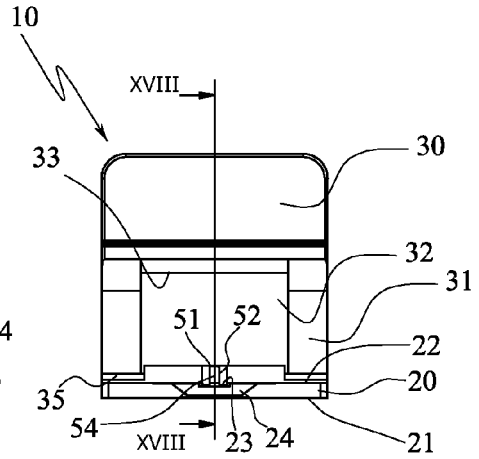
FIG. 17 is a frontal view of FIG. 15.
Figure 15:
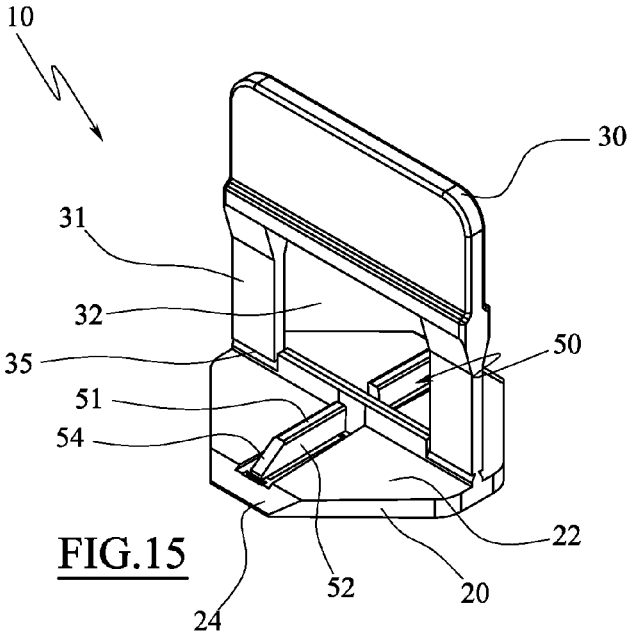
FIG. 15 is an axonometric view from above of a third embodiment of the spacing/levelling device according to the invention.
Figure 18:
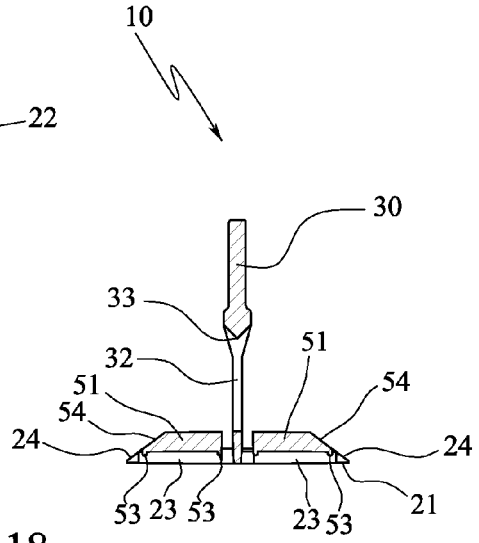
FIG. 18 is cross-section XVIII-XVIII of FIG. 17.

Thanks to the yielding nature of the material the block 51 is made of, it is arranged folded upwards by an acute angle in its raised position, while it is arranged substantially coplanar with the base 20 in its non-interfering or lowered position. FIGS. 6-7, 8-9 and 10-11 show three respective variants in the preferred embodiment which differ in the shape and arrangement of the corner spacers 50. In an alternative embodiment, shown in FIGS. 12-14, the block 51 (which can also be made of a rigid material) is slidably associated, telescopically, to the base 20 and is provided with easy-break predetermined-fracture ribs 53 destined to temporarily retain the block 51, and therefore the lateral flanks 52 thereof, in the raised position.

In practice, the base exhibits two through-slots 23 in which the blocks 51 can slide substantially snugly; the predetermined fracture ribs 50 are defined on the upper edge of each slot 23 and on the lower edge of the blocks 51. In this way, in the raised position the block 51 is maintained at a higher level than the base 20 by the predetermined fracture ribs 53, while once the ribs are broken the block 51 can slide internally of the slot 23 and lower to below the level of the base.

Lastly, in a preferred embodiment shown in figures from 15 to 18, the base 20 exhibits at least a lateral edge 24 inclined by an acute angle with respect to the lower surface 21, which edge 24 is aligned along direction A to the corner spacer 50.

The lateral edge 24 defines a rising inclined ramp which connects the lower surface 21 to the upper surface 22 of the base 20 and is extended, substantially continuously, up to the lower edge of the corner spacer 50.

Further, the corner spacer 50 also exhibits a lateral edge 54, in particular the edge 54 located externally with respect to the separating element 30, which is inclined by an acute angle with respect to the base 20.

The lateral edge 54 also defines a rising inclined ramp which connects the lower edge of the corner spacer 50 to the upper edge thereof and defines a cam profile on which, by means of a thrust along direction A exerted on the lateral edge 54, a tile P translating with respect to the device 10 along the direction A can easily cause a lowering of the corner spacer from the raised position to the lowered position, where necessary.

In particular, both the corner spacers 50 exhibit respective inclined lateral edges 54, just as the base 20 exhibits two of the lateral edges 24 opposite one another and extending with respect to the lateral edges 54 of the respective corner spacer 50.

In this case too the corner spacers 50 each comprise a block 51 slidably associated, telescopically, to the base 20 and is provided with fracture ribs 53 able to temporarily retain the block 51, and therefore the lateral flanks 52 thereof in the raised position.

As in the previously-described embodiment, in this embodiment too the fracture ribs 53 are advantageously defined below the plane defined by the upper surface 22 of the base 20, such that the part remaining attached to the base does not disturb the planarity of the tile P resting thereon.

In practice, the base 20 exhibits two through-slots 23 in which the respective blocks 51 can substantially snugly slide; the fracture ribs 53 are defined at the upper edge of each slot 23 and the lower edge of the blocks 51; in this way in the raised position the block 51 is maintained by the fracture ribs 53 at a higher level than the base 20, while once the fracture ribs are broken the block 51 can slide internally of the slot 23 and descend to below the level of the base itself.

The height of the block 51 can also be slightly greater than the thickness of the base 20, especially should the slot 23 pass from side to side of the base 20; the exceeding part of the block 51, in use, can sink into the mortar on which the device 10 is arranged without however interfering with the tile P.

In the light of the above description, the functioning of the device 10 is as follows. In order to clad a surface with a plurality of tiles P, first a layer of adhesive is spread on the ground and the tiles P laid on it.

In practice, where the first tile is to be arranged, it is sufficient to position a first device 10, the base of which 20 is destined, for example, to be located below four corners of four respective tiles P.

Once the base 20 has been positioned, as can be seen in FIG. 2, it is sufficient to position the four tiles P in such a way that each corner thereof exhibits a portion of the lateral flank in contact respectively with a lateral flank 31 of the separator element 30 and a lateral flank 52 of one of the blocks 51.

In this way the squared arrangement is guaranteed, as is the equal distance between the four tiles surrounding the device 10.

When for example the tiles P exhibit particularly large dimensions, it is possible to position a device 10 also at a median zone of the lateral flank of the tile P, as can be seen in FIG. 2.

In this configuration, the base 20 is placed below at most two flanked tiles P, such that the lateral flank of each of them rests on the lateral flanks 31 of the separator element 30.

In doing this the tile P rests on the corner spacer 50, which is brought, for example thanks to the weight of the tile P or forced by the operator doing the laying, from the raised position to the non-interfering position in which it is lowered below the level of the upper surface 22 of the base 20.

It is, for example, possible to work by first laying a tile P and then, at the corner or a flank thereof, a base portion 20 of the device can be inserted below the tile P.

For example, in relation to the embodiment shown in FIGS. 15-18, but for example also in figures from 3 to 9, in a case in which the base 20 is inserted below the tile P at a lateral flank thereof, the reciprocal translation between the tile P and the base 20 and the lowering of the corner spacer 50 from the raised position to the lowered position are facilitated by the lateral edge 54, defining the rising inclined ramp which connects the lower edge of the corner space 50 to the upper edge thereof, and, possibly, also from the underlying lateral edge 24, defining the rising inclined ramp connecting the lower surface 21 to the upper surface 22 of the base 20.

It is possible that one or more of the blocks 51 can be removed, thanks to predetermined fracture ribs entirely similar to the ones described herein above, by the personnel working on the laying, before actually laying, such that in any case the device 10 is suitable for being arranged at the corners of the tiles P (for example none or a single block 51 is removed, for example lowered) or at the sides thereof (for example when both blocks 51 are removed, for example lowered).

Once the various bases 20 with the respective separator elements 30 and corner spacers 50 have been positioned as described above, as long as the adhesive has not yet completely solidified, the various wedge elements 40 are inserted to complete the spacing/levelling device 10, which by pressing on the in-view surface of the tiles P, locally in the various points (median or corner), enable a perfect levelling of the in-view surfaces of the tiles.

The invention as it is conceived is susceptible to numerous modifications and variants, all falling within the ambit of the inventive concept.

Further, all the details are replaceable by other technically-equivalent elements.

In practice the materials used, as well as the contingent forms and dimensions, can be any according to needs, without the invention's forsaking the ambit of protection of the following claims.

The invention claimed is:

1. A spacing/levelling device (10) for laying slabs (P) for cladding laying surfaces, the device (10) comprising a base (20), positionable below the laying surface of at least two adjacent and flanked slabs (P) with respect to a flanking direction (A), from which at least a separator element (30) projects, suitable for contacting at least a portion of facing flanks of the at least two slabs (P) and a presser (40) associated to the separator element (30) and configured to act on the visible surfaces of the slabs (P) to press the slabs (P) towards the base (20) in such a way to level the slabs (P), the device (10) further comprising at least a corner spacer (50) which projects from the base (20), squared with respect to the separator element (30) and destined to come into contact with flanks that are perpendicular to the facing flanks of the slabs (P) for alignment thereof along a direction (D) that is perpendicular to the flanking direction (A), wherein in a plan view the separator element (30) and the at least a corner spacer (50) are arranged in a cross, the corner spacer (50) being mobile between a raised position, in which the corner spacer (50) projects superiorly of the base (20), and a lowered position, in which a majority thereof is at least partly contained within a majority of the base (20).

2. The device (10) of claim 1, wherein the corner spacer (50) is associated removably to the base (20), such that in the lowered position the corner spacer (50) can be detached from the base (20).

3. The device (10) of claim 1, wherein the corner spacer comprises at least a block (51) provided with two lateral flanks (52) configured to come into contact with the flanks of two slabs (P) to be flanked along the perpendicular direction (D), the block (51) being associated to the base (20) in such a way that in the lowered position the lateral flanks (52) are at least partially contained within the vertical area of the base (20) and in the raised position the lateral flanks (52) project above the base (20).

4. The device (10) of claim 3, wherein the block (51) is slidably associated telescopically to the base (20) and is provided with predetermined fracture ribs (53) adapted to temporarily constrain the lateral flanks (52) in the raised position.

5. The device (10) of claim 3, wherein the block (51) is comprised of at least a plastically or elastically yielding material and projectingly originates from the base (20).

6. The device (10) of claim 3, wherein the lateral flanks (52) of the two corner spacers (50) are, two by two, substantially coplanar.

7. The device (10) of claim 3, wherein the base (1) comprises at least a slot (23) in which the block (51) can slide substantially snugly.

8. The device (10) of claim 1, wherein a thickness in plan view of the corner spacer (50) is equal to a thickness in plan view of the separator element (30).

9. The device (10) of claim 1, wherein the device comprises at least two of the corner spacers (50) arranged on an opposite side with respect to the separator element (30).

10. The device of claim 1, wherein at least one of: a distal edge from the separator element of the corner spacer (50) or the base (20) exhibits a profile inclined by an acute angle with respect to a rest plane of the base (20).

11. The device (10) of claim 1, wherein the separator element (30) comprises a slab body fixed to the base (20) and developing perpendicularly with respect thereto, provided with a through-window (32), the upper edge (33) of which is configured to be located superiorly of a level of the visible surface of the slabs (P) and a lower edge (34) of which is configured to be located inferiorly of the level, the presser comprising a wedge element (40) configured to be inserted in the window (32) and to slide restingly on the visible surface of the slabs (P), cooperating with the upper edge (34) to push the slabs (P) towards the base (20).

12. The device (10) of claim 1, wherein the separator element (30) exhibits a line or section having a predetermined fracture (35) which in use is arranged inferiorly of a level of the visible surface of the slabs (P) to be distanced and leveled.

13. The device (10) of claim 1, wherein the cross formed by the separator element (30) and the at least a corner spacer (50) is centered with respect to the base (20).

* * * * *